United States Patent [19]

Bengert

[11] Patent Number: 5,040,102

[45] Date of Patent: Aug. 13, 1991

[54] MIRROR ARRANGEMENT FOR SHOWCASES, SHOW WINDOWS, SHOW ROOMS, THEATER SETS OR THE LIKE

[76] Inventor: Sonja Bengert, Arnulfstrasse 197, 8000 Munich 19, Fed. Rep. of Germany

[21] Appl. No.: 435,524

[22] PCT Filed: Mar. 28, 1989

[86] PCT No.: PCT/EP89/00339

§ 371 Date: Dec. 11, 1989

§ 102(e) Date: Dec. 11, 1989

[87] PCT Pub. No.: WO89/09007

PCT Pub. Date: Oct. 5, 1989

[30] Foreign Application Priority Data

Mar. 28, 1988 [DE] Fed. Rep. of Germany ..... 3810520

[51] Int. Cl.[5] ..... A47F 11/04

[52] U.S. Cl. ..... 362/125; 312/114

[58] Field of Search ..... 312/223, 224, 225, 102, 312/114; 362/125, 31

[56] References Cited

U.S. PATENT DOCUMENTS

| | | | |
|---|---|---|---|
| 1,605,221 | 11/1926 | Davis . | |
| 2,118,131 | 8/1936 | Alexander | 40/130 |
| 2,703,743 | 3/1955 | Harwood | 312/225 |
| 3,502,402 | 3/1970 | Markson | 352/69 |
| 4,132,456 | 1/1979 | Lewis et al. | 312/323 |
| 4,133,589 | 1/1979 | Johns | 312/324 |
| 4,281,883 | 8/1981 | Zacky | 312/324 |
| 4,922,384 | 5/1990 | Torrence | 362/31 |

FOREIGN PATENT DOCUMENTS

| | | |
|---|---|---|
| 8528011 | 3/1986 | Fed. Rep. of Germany . |
| 1561332 | 3/1969 | France . |
| 185307 | 11/1935 | Switzerland . |
| 1545504 | 5/1979 | United Kingdom . |

*Primary Examiner*—Ira S. Lazarus
*Assistant Examiner*—Sue Hagarman
*Attorney, Agent, or Firm*—Henry M. Feiereisen

[57] ABSTRACT

A mirror arrangement having two parallel side walls 2, a front wall 3 with semireflecting mirror and a rear wall 4 creates an improved visual effect by arranging the front wall 3 and the rear wall 4 non-parallel to each other. The base of the compartment enclosed by the walls 2, 3 and 4 is thus trapezoid, and between the front and rear walls 3, 4 and an adjoining side wall 2 an acute angle $\alpha$ is defined which does not exceed 85°. The walls 2, 3 and 4 are secured to a frame 9 of square tubes 10. Several showcases 1 composed of the walls 2, 3 and 4 and the frame 9 can be joined together in any number and design at any size through modular assembling. In the showcases, a number of juxtaposed mirror images of the objects, which are exhibited in the showcases, are generated along a primary path which is flanked by further, in some cases opposingly arched paths so as to allow viewing of the objects from all sides.

16 Claims, 5 Drawing Sheets

MIRROR ARRANGEMENT FOR SHOWCASES, SHOW WINDOWS, SHOW ROOMS, THEATER SETS OR THE LIKE

The invention relates to a mirror arrangement for showcases, show windows, showrooms, theater sets or the like, having plane mirrors forming both side walls and front wall and rear wall of a compartment of tetragonal base, with the mirrors being arranged perpendicular to the base and having inwardly facing reflecting surfaces wherein the side walls are parallel to each other and the front wall or rear wall extends rectangular to the side walls, with the front wall being a semireflecting mirror and wherein a light source is provided for illuminating the compartment.

Such a mirror arrangement is known e.g. from the DE-OS No. 27 30 679. This mirror arrangement includes parallel front and rear walls so that the base of the compartment defines a rectangle. The mirror arrangement gives an observer, who views the compartment through the front wall, the impression of an infinitely deep space. The observer sees an object placed into the compartment in almost endless sequential arrangement, with images from the front alternating with images from the rear. By the parallel arrangement of the front and rear walls, the light rays are reflected toward each other so that the mirror images of the object rapidly loose contrast and become darker with increasing simulating depth, and the mirror image located in the sequence "further behind" will hardly show details of the respective side of the object. Moreover, the parallel arrangement of the front and rear walls of the compartment only generates mirror images of the front and back of the object, with the mirror images which show the rear and the mirror images which show the front overlapping over a major part. Further, the known mirror arrangement gives the observer the impression that the sequential arrangement of the mirror images of the object is attained rectilinear in depth direction. Rectilinearity of the sequential arrangement of the mirror image may, however, bore the observer so that the interest in the image as produced by the known mirror arrangement rapidly diminishes. Such a reaction by the observer is undesired when using the mirror arrangement for showcasing objects for advertising purposes.

An alternative embodiment of the mirror arrangement known from the DE-OS No. 27 30 679 avoids the drawbacks encountered through the parallel arrangement of the front and rear walls by forming the rear wall through two mirrors which extend at an angle to each other. However, this embodiment of the known mirror arrangement has the drawback of generating mirror images of the object in such great number and in such a plurality of directions that the overall image appears to the observer as completely disorganized and cut up and renders it difficult for the observer to recognize the one mirror image which shows the object from a side which is of special interest to him. This confusion becomes even greater the more objects are exhibited in the compartment. This alternative embodiment of the known mirror arrangement is thus not suitable for advertising purposes or to inform the observer about the looks of those sides of the real object which are invisible from the front, and especially unsuitable for exhibiting several objects.

It is the object of the invention to design a mirror arrangement of this type in such a manner that the observer is able to view in an orderly manner mirror images even of several objects located in the compartment and to clearly see the objects from all sides, with the rectilinear juxtaposition of the mirror images being avoided. The overall image thus gives the observer considerable information about the objects and draws attention to the objects without becoming boring after a short period.

In accordance with the invention, this object is attained by a mirror arrangement in which the front wall and the rear wall are not parallel to each other. The base of the compartment is thus trapezoid, with the parallel side walls defining the base and the front wall and rear wall defining its legs, with one of the legs i.e. the front wall or the rear wall extending rectangular to the base lines i.e. side walls.

Through the mirror arrangement according to the invention, each object is shown by a plurality of mirror images at a contrast and lightness which essentially corresponds to the object. The mirror images are sequentially arranged toward the depth of the space along a primary arc-shaped path which is flanked by other in some cases opposingly arched paths, with the mirror images depicting the object at increasing angle of rotation with increasing depth and being laterally offset to such a degree that the object can be viewed from all sides. This effect of the mirror arrangement according to the invention is independent of the size of the compartment and of the mean distance between the front wall and the rear wall but is dependent solely from the combination of the angles of the base. The mirror arrangement according to the invention is thus suitable with constant success for every size and type of show room or exhibition space, from the showcase via the show window up to the exhibition space in room size, and is further conceivable as scenery in theaters. In particular, the mirror arrangement according to the invention is suitable for advertising purposes because the depiction of the objects is attained in a manner by which the underlying reflection principle remains puzzling to the observer and thus draws his attention and interest while still completely informing the observer about the looks of the object or objects.

Preferably, the one front wall or rear wall which does not extend rectangular to the side walls define on one end with the adjoining side wall an acute angle $\alpha$ which does not exceed 85° and preferably is not smaller than 70°. It has been found that an acute angle $\alpha$ of 83° is optimal. The selection of such an acute angle $\alpha$ ensures that the sequential arrangement of the mirror images is not laterally deflected too far which would cause only few mirror images to be viewable by the observer, and yet does not approximate a straight line without sufficient rotation of the mirror images.

Preferably, the base of the compartment is a bottom which is represented by a mirror with upwardly facing reflecting surface to thereby reinforce the reflecting effect and to afford the observer the possibility of viewing an object, which is showcased in the compartment, also from below.

At least one partition which extends parallel to the side walls may be detachably secured between both side walls and formed by a pair of fully reflective mirrors, with the reflecting surfaces facing outwardly. Thus, a multiplication of the compartment is created for increasing the visual effect. It may, however, be desirable to divide the compartment in order to avoid that too many individual objects have to be exhibited and to prevent the overall image as created by the mirror arrangement from appearing overloaded. A division of the compartment may especially be suitable when exhibiting different objects of the same type.

For the same reasons, it may be suitable to arrange a pair of two adjacent compartments in such a manner that the longer side walls face each other with their outer surfaces and that the front walls are arranged side-by-side.

Further, there is the possibility of arranging several pairs of two adjacent compartments upon one another so that two parallel rows of superimposed compartments are created, with each row having a common front wall rendered invisible in the area which does not define the respective compartment such as e.g. the area of the chamber accommodating the light source. Such a mirror arrangement is especially of advantage when exhibiting various objects for sales or advertising purposes and allowing selective illumination of the compartments to give the observer alternating views of various compartments.

Depending on the view point from which the compartment is usually viewed or approached, it may be advantageous to provide the front wall at one end at an acute angle $\alpha$ with the adjoining side wall. The mirror arrangement according to the invention is thus adaptable to the view point of the observer regardless of the showplace whereby the visual effect created by the mirror arrangement remains the same.

According to a preferred embodiment of the mirror arrangement of the invention, the front, rear and side walls of the or each compartment is mounted to a self-supporting frame of elongated components, with the frame having a trapezoid base which is angled in correspondence to the base of the compartment and with at least the side walls being arranged essentially within the outer boundaries of the frame and the front wall being arranged at an external side of the frame. Thus, the mirror arrangement according to the invention is stable and flexible with regard to design and dimensions and its manufacture is simple.

Preferably, the elongated components are detachably connected at their corners of the frame with links by means of screws. The structure of the mirror arrangement according to the invention is thus especially simple. Moreover, subsequent modifications of the design and size can then be carried out in a simple manner. The mirror arrangement according to the invention is especially suitable for expansion as modular assembly. The individual compartments can then be adjoined in desired number and design. Also, any size is selectable. By virtue of this dimensional independence, the mirror arrangement according to the invention can be used in a number of ways.

It is possible to arrange laterally of the frame a further frame which is combined with the first-mentioned frame to a frame unit, with the side components of only one frame being arranged at the junction of the frames.

Moreover, several frame units may be arranged upon one another and connected with each other, and below the lowermost framework a bottom frame may be arranged which has the same base as the superimposed frame units and forms a lower chamber accommodating a control unit which selectively switches the light sources on and off. The light sources are respectively provided in the compartments of the frame units for illuminating each compartment. The individual compartments may thus be alternately illuminated, with the number of illuminating compartments and the duration of illumination and sequence being controllable to complement the effect of the unexplained reflection by a further effect for drawing further attention.

By means of the mirror arrangement according to the invention, the actually provided room in which the observer is present is expanded by an optically infinite space. The mirror arrangement according to the invention is adaptable to the view point of the observer, and objects can be seen even from extremely oblique view points. Further, the size of the view point range is adaptable to the position of the observer because the acute angle $\alpha$ is defined either between the front wall or front walls and the side walls or between the rear wall or rear walls and the side walls. The mirror arrangement according to the invention has thus the advantage of being easily adaptable to the conditions of the showplace, the position of the observer and the characteristics of the exhibited object. For advertising purposes, the mirror arrangement according to the invention is of utmost efficiency. The expansion of space created by the mirror arrangement according to the invention may further be variably designed, with the actually existing space being opened in any direction depending on the arrangement, number and design of the mirrored compartments.

An exemplified embodiment of the invention is illustrated in the drawings and is subsequently described in detail, wherein.

Figure 1:
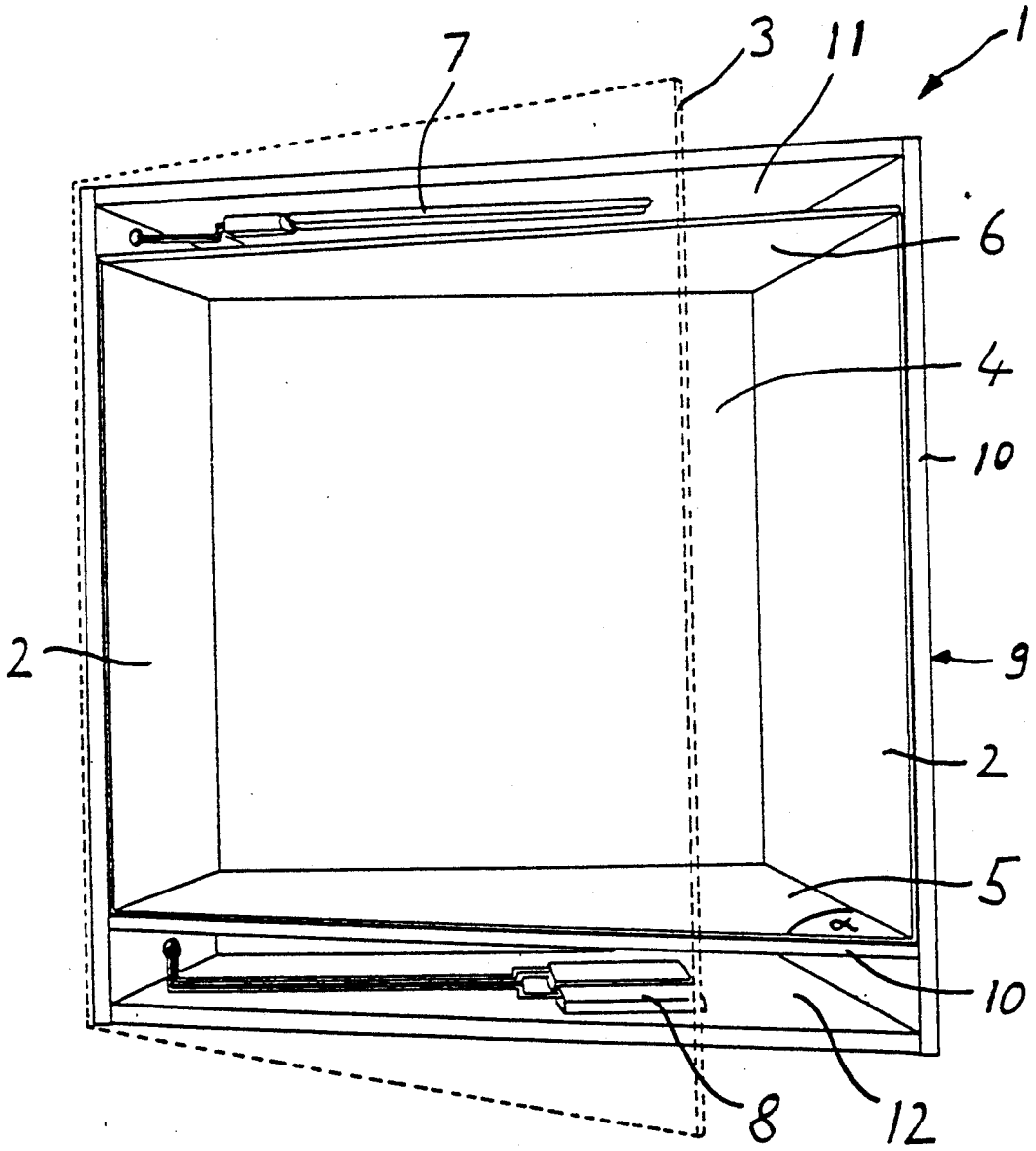
FIG. 1 is a schematic front illustration of a mirror arrangement for a single showcase, with the front wall being designed as swing door and shown in broken lines in partly open position.
Figure 3:
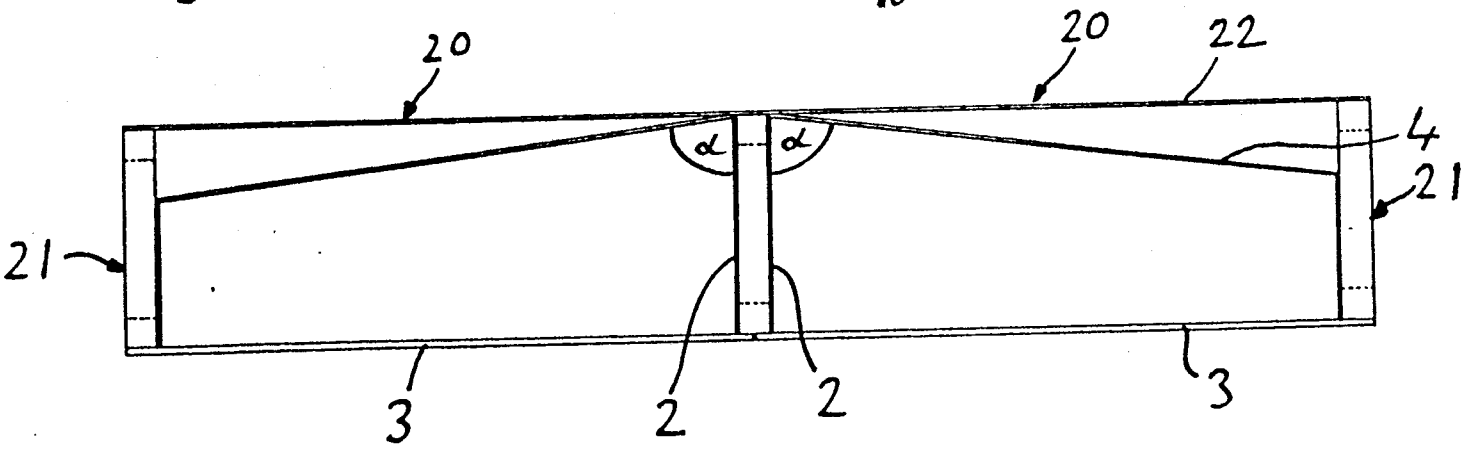
Figure 4:
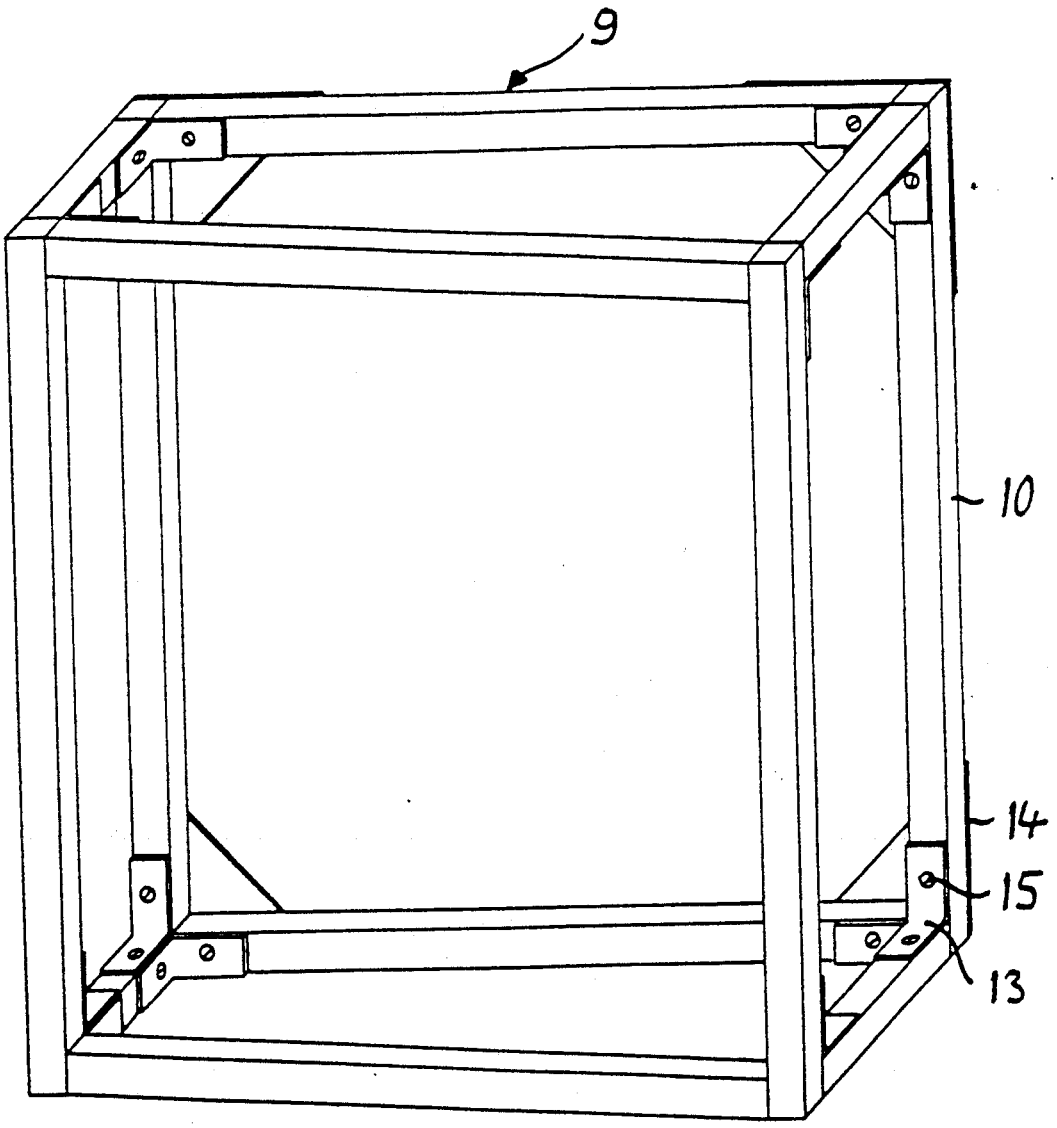
Figure 5:
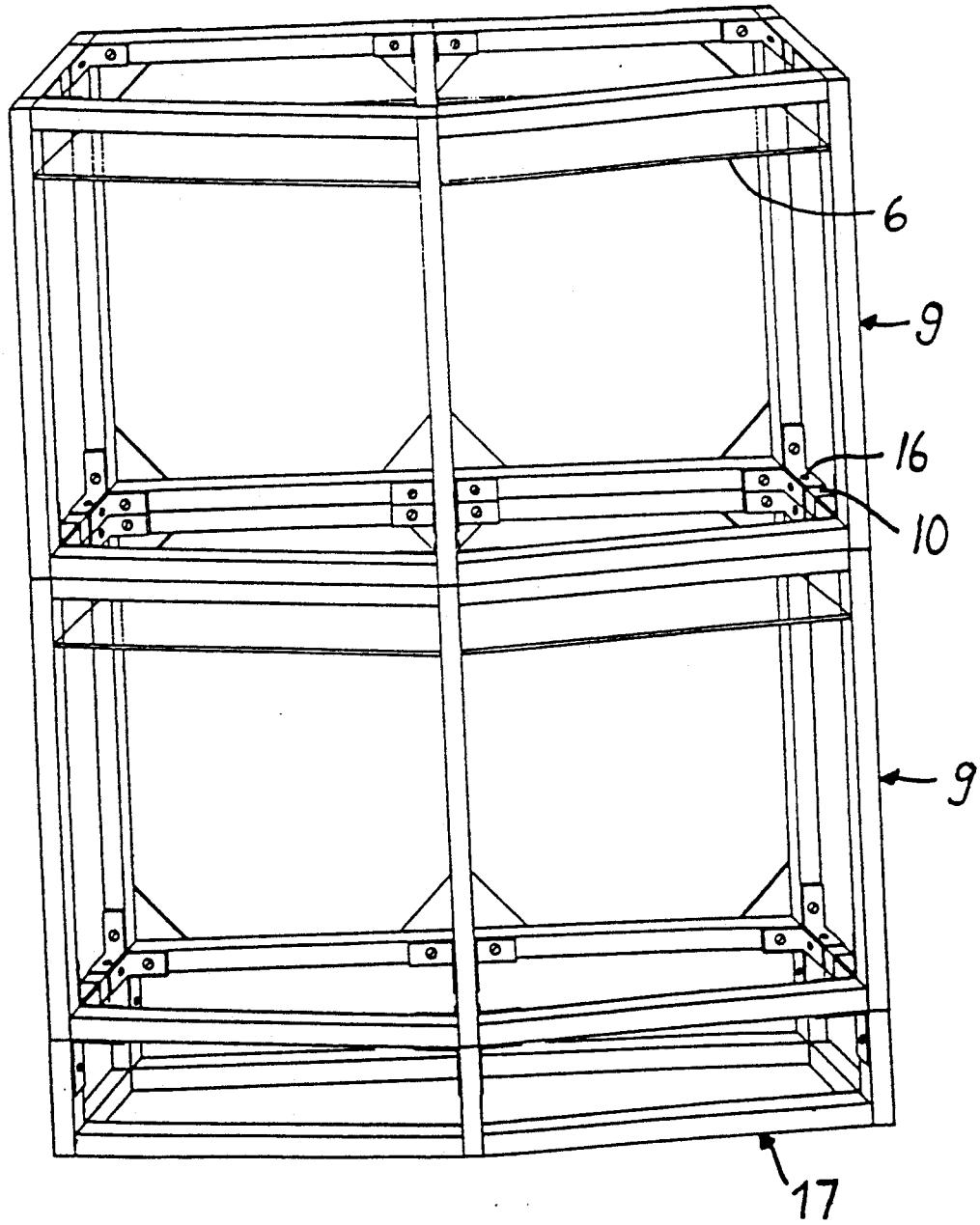
Figure 6:
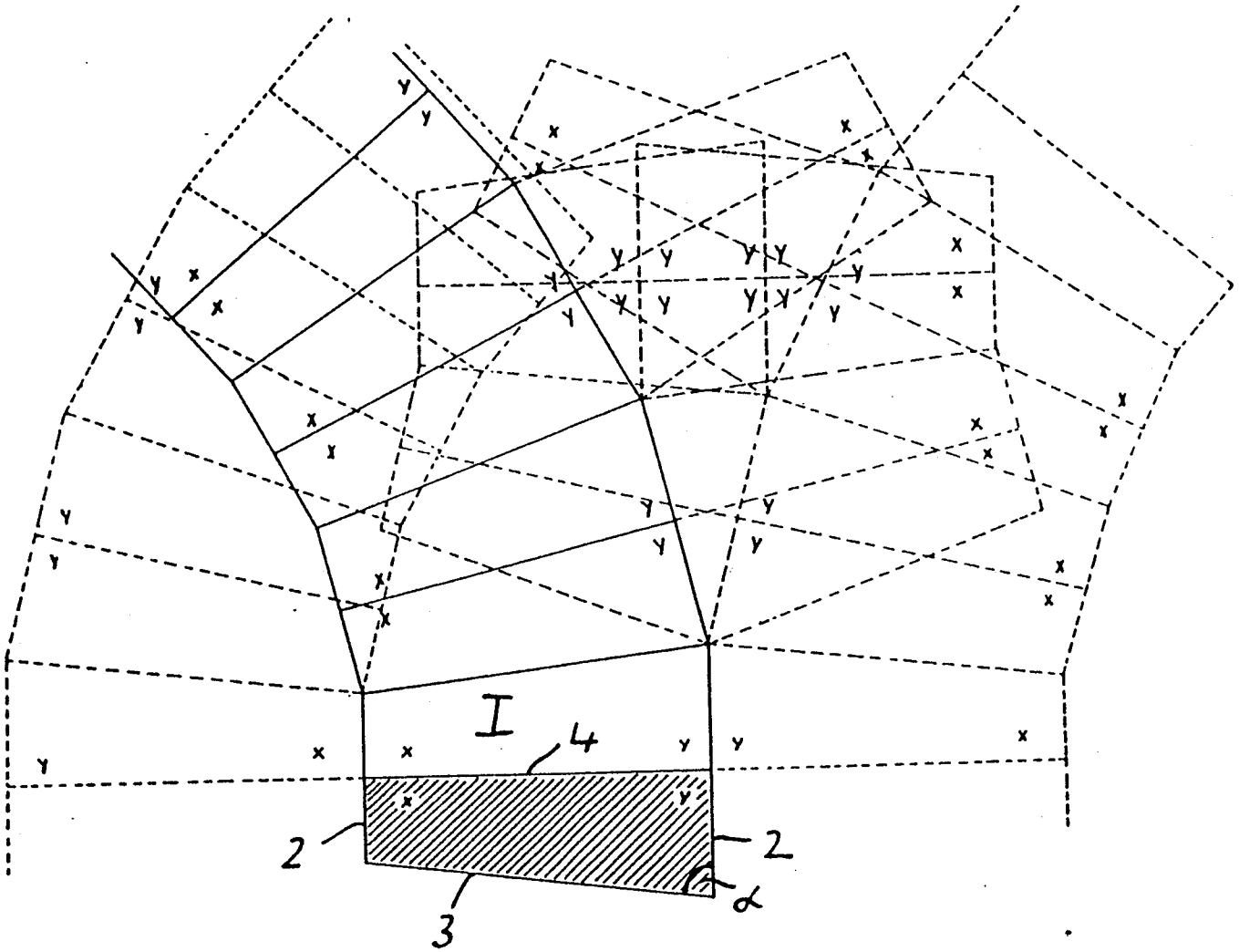

FIG. 3 a similar sectional illustration as in FIG. 1 of a mirror arrangement for two adjacent and laterally connected individual showcases, with both rear walls defining an acute angle $\alpha$ at one end with the adjoining side wall and with both front walls extending in one plane;

FIG. 4 is a perspective illustration of a frame for a single showcase;

FIG. 5 is a perspective illustration of the frame of a mirrored cabinet consisting of four single showcases, with four single frames and a bottom frame being assembled and connected together and the compartment of each individual showcase being shown with an upwardly restricting transparent plate for light scattering; and FIG. 6 is a geometric illustration of the reflection principle of the mirror arrangement according to the invention according to FIG. 1.

A mirror arrangement for a single showcase 1 as illustrated in FIG. 1 includes two parallel side walls 2, a front wall 3 which is designed as swing door and a rear wall 4. The side walls 2 and the front and rear walls 3, 4 stand perpendicular on a horizontal bottom 5. The side walls 2, the front and rear walls 3 and 4 as well as the bottom 5 include plane, fully reflecting mirrors with the reflecting surfaces facing inwardly and upwardly, respectively. The front wall 4, on the other hand, includes a plane semireflecting mirror. The term fully reflecting mirror refers to a mirror which completely reflects the incident light on its reflecting surface. The term semireflecting mirror refers to a mirror which is partly transparent. Semireflecting mirrors are basically known and may be made in various manners. One way to make a semireflecting mirror includes vacuum metallizing silver on a transparent glass plate, with the coating kept so thin that incident light can partly pass therethrough. A semireflecting mirror made in this manner is used in the present exemplified embodiment.

The semireflecting mirror has the effect that an observer standing in front of the compartment enclosed by the walls 2, 3 and 4 can look into the compartment while incident light on its back side is reflected backwards almost like a fully reflecting mirror. In the event the compartment is dark, the front of the semireflecting mirror reflects incident light forwards almost like a fully reflecting mirror.

The compartment enclosed by the walls 2, 3 and 4 has a trapezoid base, with both side walls 2 defining the parallel base lines of the trapezoid and the front and rear walls 3 and 4 defining the leg of the trapezoid. When being closed, the front wall 3 does not extend parallel to the rear wall 4 which is arranged rectangular to the side walls 2. Thus, the closed front wall 3 defines an acute angle $\alpha$ with the adjacent side wall 2. The acute angle $\alpha$ is in the range between 70° and 85° and is about 83° in the exemplified embodiment.

The bottom 5 has the shape of the base of the compartment enclosed by the walls 2, 3 and 4. A transparent plate 6 which extends parallel to the bottom 5 bounds the compartment in upward direction and ensures scattering of the light of a light source 7 arranged above the plate 6 for illuminating the compartment. The light source 7 is a daylight lamp and may be controlled by an electronic control unit 8 which is arranged below the bottom 5 and switches on/off and/or light/dark possibly in accordance with a given program.

The walls 2, 3 and 4 are mounted to a self-supporting frame 9 which is made of square tubes 10 of aluminum as illustrated in particular in FIG. 4. The frame 9 has also a trapezoidal base which is angled in correspondence to the base of the compartment enclosed by the walls 2, 3 and 4. As can be seen from FIG. 1, the side walls 2 are arranged within the outer side boundaries of the frame, and the front wall 3 is arranged at the front exterior of the frame 9. The rear wall 4 extends in the plane of the rear boundary of the frame 9. The transparent plate 6 is arranged at a distance below the upper boundary of the frame 9 so that an upper chamber is defined between the upper boundary of the frame 9 and the transparent plate 6 for accommodating the light source 7. The bottom 5 extends at a distance above the lower boundary of the frame 9 so that a lower chamber 12 is defined between the bottom and the lower boundary for accommodating the electronic control unit 8. The front wall 3 is rendered invisible in the area of the upper chamber 11 and the lower chamber 12.

The square tubes 10 forming the components of the frame 9 are detachably secured together at the corners of the frame 9 by means of angular plate-shaped links 13 and 14 which are fastened to the square tubes 10 by screws 15.

In the single showcase illustrated in FIG. 1, the bottom 5 rests on horizontal square tubes 10 which are connected to the vertical square tubes 10 of the frame 9.

At illumination and closed front wall 3, a not shown object placed within the compartment is multiply mirrored by the walls 2, 3 and 4 and the bottom 5, whereby an observer standing in front of the showcase is able to look into the compartment enclosed by the walls 2, 3 and 4 because the illumination makes the semireflecting mirror of the front wall transparent. The observer perceives the compartment as infinitely deep, and he sees the object in a number of mirror images which are juxtaposed in several directions and depict the object increasingly turned with increasing depth so that the object is clearly viewed from all sides when observing various mirror images of the object. The sequential arrangement of the mirror images extends along an arc-shaped path which is flanked by further, in some cases opposingly arched paths, with the primary curvature of these paths being determined by the acute angle $\alpha$.

FIG. 6 illustrates the reflection principle, with the trapezoid base of the actual compartment being hatched and the front wall defining at one corner an acute angle with the adjacent side wall similar to the showcase illustrated in FIG. 1. The first reflection plane in FIG. 6 is designated by I and corresponds to the base of a compartment in which the front wall is arranged rectangular to the side walls, and the rear wall defines at one corner an acute angle $\alpha$ with the adjacent side wall. The primary arc-shaped path is illustrated by a continuous line and the remaining arc-shaped paths are illustrated in broken lines.

Each object placed in the showcase 1 is multiply reflected until being blurred in the optical infinite space behind the semireflecting mirror. Depending on the position or view point of the observer, the object can be pursued in one or the other direction and is depicted from all sides because of the optical rotation of the mirror images.

As shown in FIG. 6, this effect is not dependent on the dimensions of the compartment enclosed by the walls 2, 3 and 4 and, from a mean minimum distance of about 10 cm, on the mean distance between the front wall 3 and the rear wall 4 but is dependent solely on the combination of the angles of the base.

Figure 2:
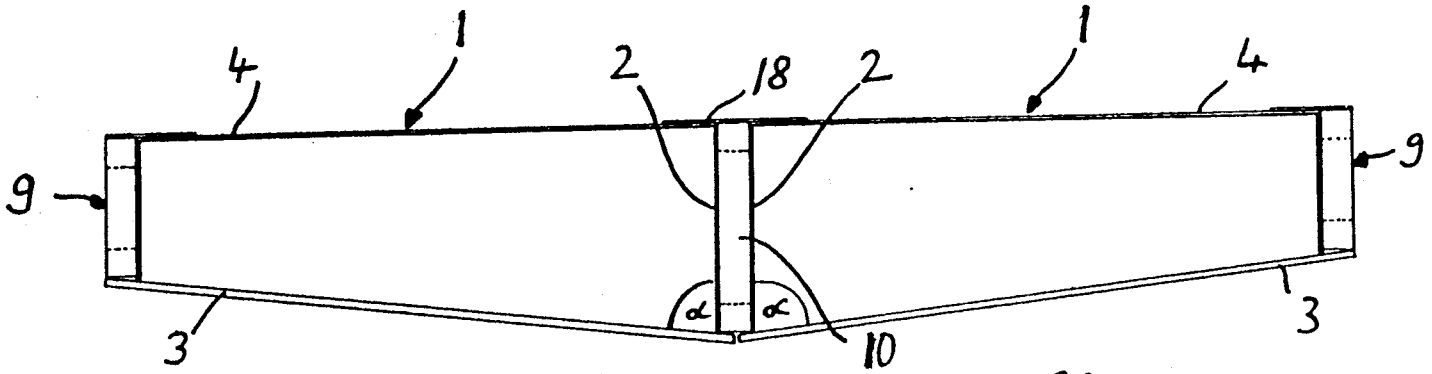
FIG. 2 is a section through a mirror arrangement for two adjacent and laterally connected individual showcases, with both front walls defining an acute angle $\alpha$ at one end with the adjoining side wall.

FIG. 2 shows a sectional view of two adjacent individual showcases connected at their rear by plates 15. The design of each showcase 1 corresponds essentially to the showcase depicted in FIG. 1, with the exception at the junction of both showcases, where the vertical and horizontal side square tubes 10 of the frame are provided of only one showcase. The horizontal square tubes 10 of the front and rear of the one frame 9 are directly connected with the horizontal and vertical side square tubes 10 of the other frame 9. The plates 18 are secured by means of screws to both frames in the same manner as the links 13 and 14 so that both showcases 1 may be disassembled again, if necessary.

As can be seen from FIG. 2, both showcases 1 are joined together in such a manner that the longer side walls 2 face each other with their exterior and both front walls 3 are arranged side-by-side. Such a mirror arrangement, as illustrated in FIG. 2, results in a very large view point range which allows to see the objects exhibited in the showcases 1 from all sides even from positions which are extremely laterally oblique relative to the showcases. The effect of the mirror arrangement can thus be viewed by a greater number of passing persons more quickly and for a longer period.

In the mirror arrangement illustrated in FIG. 2, the acute angles $\alpha$ are identical. It is, however, also possible to provide different angles $\alpha$ because the simple structure of the showcases allows initially to easily consider or subsequently to easily attain various angles $\alpha$. Selection of the acute angle $\alpha$ depends on the conditions of the showplace, the size of the area available for the person perceiving the effect of the mirror arrangement, or on the walking direction of the persons passing the showcases. The mirror arrangement illustrated in FIG. 2 is basically suitable for such a showplace, with the showcases being approached by persons in a very broad angular area.

Like FIG. 2, FIG. 3 illustrates two adjacent showcases 20 suitably connected with each other in a not shown manner and differing from the showcases as illustrated in FIG. 2 especially in that the front walls 3 extend in one plane and the rear walls 4 define on one end an acute angle $\alpha$ with the adjoining side wall 2. Moreover, in contrast to the frames 9 of the showcases 1, the frames 21 of both showcases 20 have a rectangular base. The compartment of each showcase 20 is enclosed by the walls 2, 3 and 4 and has the same base as the compartment of the showcase 1 enclosed by the walls 2, 3 and 4; only the acute angle $\alpha$ is provided at the rear instead at the front.

In the same manner as the showcases 1 of FIG. 2, the showcases 20 of FIG. 3 include front walls 3 with semi-reflecting mirrors and rear and side walls 4, 2 with fully reflecting mirrors. Both showcases 20 are connected with each other at the back by a flat plate 22 in order to provide a flat surface for covering the back of both showcases 20. This is suitable when setting up the showcases 20 with their back against a wall.

The reflection effect created by the mirror arrangement according to FIG. 3 is the same as the one created by the mirror arrangement according to FIG. 2. Only the view point range, which allows viewing of the objects exhibited in the showcases from all sides is smaller than in the mirror arrangement according to FIG. 2. The mirror arrangement according to FIG. 3 is thus suitable especially for a showplace in which the observers approach the showcases within a narrow radius.

FIG. 5 illustrates the framework of a mirrored cabinet with two pairs of adjoining showcases according to FIG. 2 and arranged upon one another and connected together. The connection between the upper and lower pair of frames is attained by means of screws 16 which are sufficiently long in order to tranverse the superimposed horizontal square tubes 10 at the sides of the frames 9. Below the lower pair of frames is a bottom frame 17 which has the same base as the superimposed pair of frames. The bottom frame is connected to the superimposed pair of frames through angular links and screws in like manner as the connection between the other frames. An electronic control unit may be installed in the space within the bottom frame 17 for program controlling the not shown light sources which are respectively assigned to each showcase of the cabinet. Like the showcase illustrated in FIG. 1, each showcase of the cabinet as depicted in FIG. 5 is provided with a transparent plate 6, above which a space is provided for accommodating a not shown light source. The arrangement of the front, rear and side walls is the same as in the mirror arrangement according to FIG. 2. Two superimposed showcases have a common front wall with semireflecting mirror which may be designed as swing door or sliding door in a same manner as in the mirror arrangement according to FIG. 2 and FIG. 3 and is rendered invisible in the areas of the chambers accommodating the respective light sources and in the areas of the bottom frame 17.

All visible external surfaces of the frame or of the pair of frames may be covered by suitable decorating elements of suitable material and in suitable decor such as e.g. panels of wood or metal mounted to the square tubes 10 of the frame 9 and 21, respectively.

Preferably, each showcase includes in the area between the bottom 5 and the upper plate 6 one or more transparent or mirror-coated plates which extend parallel to the bottom 5 and upon which the objects to be exhibited may be placed. When using several plates in each showcase, these plates may be arranged at different levels.

Any number of showcases 1 may be joined and designed by modular assembling. The cabinet illustrated in FIG. 5 is only shown as an example for the number and arrangement of the individual showcases. It is certainly feasible to assemble more or less than four showcases to a cabinet. Also the arrangement of the individual showcases may differ from the cabinet illustrated in FIG. 5. For example, several showcases may be separately arranged in a room and selectively switched light/dark and/or on/off by a common control unit. Also the size of the individual showcases may vary within broad limits. Larger showcases require only modification of size and strength of the components of the frame. Only the angles of the base of the compartment enclosed by the walls 2, 3 and 4 remains constant.

What is claimed:

1. Mirror arrangement for showcases, show windows, showrooms, theater sets or the like, having plane mirrors forming both side walls and front wall and rear wall of a compartment of tetragonal base, with the mirrors being arranged perpendicular to the base and having inwardly facing reflecting surfaces wherein the side walls are parallel to each other and the front wall or rear wall extends rectangular to the side walls, with the front wall being a semireflecting mirror and wherein a light source is provided for illuminating the compartment, characterized in that the front wall (3) and the rear wall (4) extend non-parallel to each other wherein the front or rear wall (3,4) which does not extend rectangular to the side walls (2) defines at one end with the adjoining side wall (2) an acute angle $\alpha$, which does not exceed 85° and is not smaller than 70°.

2. Mirror arrangement according to claim 1, characterized in that the base of the compartment is a bottom (5) which is formed by a mirror with upwardly facing reflecting surface.

3. Mirror arrangement according to claim 2, characterized in that one or more transparent or mirror-coated plates is or are arranged parallel to the bottom (5) in each compartment in the area between the bottom (5) and the upper end of the side walls (2) for receiving objects placed in the compartment.

4. Mirror arrangement according to one of the preceding claims, characterized in that at least one partition is detachably secured between both side walls (2) and extending parallel to the side walls (2), the partition being formed by a pair of fully reflecting mirrors with outwardly facing reflecting surfaces.

5. Mirror arrangement according to claim 1, characterized by a pair of two compartments which are arranged side-by-side, with the front walls (3) adjoining each other, said pair of two compartments having longer side walls (2), with their exterior facing each other.

6. Mirror arrangement according to claim 5, characterized in that several pairs of two adjacent compartments are arranged upon one another so that two parallel rows of superimposed compartments are created, each row having a common front wall (3) which is made invisible in the area which does not define the respective compartment.

7. Mirror arrangement according to claim 1, characterized in that the acute angle $\alpha$ is 83°.

8. Mirror arrangement according to claim 1, characterized in that the front, rear and side walls (2, 3, 4) of the or each compartment is mounted to a self-supporting frame (9) of elongated components (10), that the frame (9) has a trapezoid base which is angled in correspondence with the base of the compartment, and that at least the side walls (2) are essentially arranged within the outer boundaries of the frame (9) and the front wall (3) is arranged at an exterior side of the frame (9).

9. Mirror arrangement according to claim 8, characterized in that the elongated components (10) are detachably connected together at the corners of the frame (9) via screws (15) by means of links (13, 14).

10. Mirror arrangement according to claim 8, characterized in that the compartment defined by the side walls, rear and front walls (2, 3, 4) is upwardly restricted by a transparent plate (6) which is arranged at a distance below the upper boundary of the frame (9), with an upper chamber (11) being defined between the transparent plate (6) and the upper boundary of the frame for accommodating the light source (7).

11. Mirror arrangement according to claim 8, characterized in that a further frame (9) is arranged laterally of the frame (9) and joined together with the latter frame (9) to a frame unit, with the side components (10) of only one frame (9) being provided at the junction.

12. Mirror arrangement according to claim 11, characterized in that several frame units are arranged upon one another and connected with each other, and that below the lowermost frame unit a bottom frame (17) is arranged which has the same base as the superimposed frame units, and that a lower chamber is formed in the bottom frame (17) for accommodating a control unit for selectively switching the light sources on and off which are respectively assigned to the compartments in the frame units for illuminating each compartment.

13. Mirror arrangement according to claim 11, characterized in that at least the lateral boundaries of the frame or the frame unit is covered with decoration elements.

14. Mirror arrangement according to one of the claims 8 to 10, characterized in that the bottom (5) of the compartments is arranged at a distance above the lower boundary of the frame (9), with a lower chamber being defined for accommodating a control unit (8) for light/dark switching and/or interval switching of the light source (7).

15. Mirror arrangement according to claim 1, characterized in that the front wall is designed as a swing door or a sliding door.

16. Mirror arrangement for showcases, show windows, showrooms, theater sets or the like; comprising a front wall with a semireflecting mirror;

a mirrored rear wall extending non-parallel to said front wall; and mirrored side walls extending parallel to each other and connecting said front and rear walls to define a compartment for displaying an object, wherein one of said front and rear walls extends rectangular to the side walls and defines with an adjoining side wall an acute angle $\alpha$ ranging between 70° and 85°.

* * * * *